United States Patent [19]

Hansing

[11] Patent Number: 4,767,139

[45] Date of Patent: Aug. 30, 1988

[54] LATCH ASSEMBLY FOR RECREATIONAL VEHICLE DOORS

[75] Inventor: Ronald J. Hansing, Niles, Mich.

[73] Assignee: Philips Industries Inc., Dayton, Ohio

[21] Appl. No.: 121,751

[22] Filed: Nov. 16, 1987

[51] Int. Cl.[4] ..... E05C 7/02

[52] U.S. Cl. ..... 292/162; 292/DIG. 21; 292/150; 49/62; 49/163

[58] Field of Search ..... 292/156, 162, 150, 157, 292/DIG. 21; 49/62, 163

[56] References Cited

U.S. PATENT DOCUMENTS

| | | | |
|---|---|---|---|
| 116,646 | 7/1871 | Van | 292/162 |
| 215,439 | 5/1879 | Crane . | |
| 306,286 | 10/1884 | Sawtelle et al. | 292/162 |
| 541,930 | 7/1895 | Harper | 292/156 |
| 1,100,564 | 6/1914 | Heryford . | |
| 1,674,221 | 6/1928 | Preen et al. | 292/162 X |
| 2,537,896 | 1/1951 | Hinton et al. | 292/DIG. 21 X |
| 3,722,237 | 3/1973 | Taylor | 70/107 |
| 4,094,099 | 6/1978 | Birch | 49/163 |

*Primary Examiner*—Richard E. Moore

*Attorney, Agent, or Firm*—Biebel, French & Nauman

[57] ABSTRACT

A latch assembly for recreational vehicle doors in which a closure door and a screen door are hinged about common axes includes a latch bolt which is adapted for mounting on a vertical stile of the screen door and is movable into engagement with a keeper plate. A latch bolt retainer is mounted on an inside surface of the prime closure door. The latch bolt retainer has portions which cooperate with the latch bolt on the screen door such that when the prime closure door is closed against the screen door, the retainer captures the latch bolt on the screen door and retracts it from the keeper and retains the latch bolt in a retracted position. The capturing movement is accompanied by alignment movement of the screen door latch bolt with respect to the retainer so that the screen door is held in a predetermined aligned position in the retainer.

6 Claims, 3 Drawing Sheets

LATCH ASSEMBLY FOR RECREATIONAL VEHICLE DOORS

BACKGROUND OF THE INVENTION

This invention relates to latch assemblies for recreational vehicle doors, and more particularly to a latch assembly for selectively connecting a screen door to the outside or prime closure door.

Recreational vehicles commonly have a hinged screen door which cooperates with an outer closure door, in that it may be moved independently of the closure door or may be attached to the closure door. A typical outer prime door and screen door assembly is shown in Birch, U.S. Pat. No. 4,094,099 issued June 19, 1978, in which the screen door and prime door are pivotally mounted on common axes to a common door frame. The screen door includes an upper screened panel, a lower screened panel, and an intermediate slide panel, through which access may be had to the conventional inside latch mechanism of the prime door. The screen door and prime door are which hinged on the common door frame of the recreational vehicle open outwardly from the door opening.

Conventionally, a magnetic or detent type of latch is employed for retaining the screen door within the prime door when it is desired that they operate together. Such conventional latches fail to provide a positive screen door latch engagement to the prime door when it is desired that they move together, and fail to provide an arrangement by which the prime door can automatically disengage the screen door from its frame strike and pick up the screen door for movement with to the prime door in the active mode. Further, such systems fail to provide for vertical alignment and support of the screen door when stored with or attached to the prime door, so that correct alignment is maintained at the time of closing, against the door seals.

SUMMARY OF THE INVENTION

This invention relates to an improved recreational vehicle screen door latch assembly which provides for positive screen door engagement with an outer closure door, in an active mode in which the screen door is latched to the closure door. The assembly further provides for the automatic capture by the closure door of the screen door when the closure door is closed against the screen door or when the screen door is pushed into its storage position against the closure door.

The latch assembly includes a transversely movable latch bolt mounted on the screen door. The latch bolt is spring-biased into an outer keeper-engaging position on the vertical edge of the door frame, for latching the screen door in the passive mode, when the principal closure door is operated independently of the screen door.

The assembly further includes a latch bolt retainer member mounted on the closure door. The retainer member has bolt-engaging portions which are proportioned to engage the latch bolt in its latched or outer position, when the closure door is closed against the screen door. The latch bolt retainer member operates, when engaging the latch bolt, to retract the latch bolt against a biasing spring, thereby automatically releasing the latch bolt from the keeper.

The retainer member further is arranged to capture the latch bolt on the retainer member and, simultaneously, align and vertically position the screen door with respect to the prime door, to maintain a desired and correct alignment between the doors. The screen door may be easily detached from the prime door merely by retracting the latch bolt and thereby releasing the latch bolt from the retainer member.

A further feature of the latch assembly of this invention resides in the fact that the parts may be pre-positioned and retained by temporary alignment pins, for assembly onto the recreational vehicle doors. This is a particular advantage in making an assembly in the field, and the alignment pins may thereafter be removed to provide for proper functioning of the latch assembly. In this manner, the latch assembly provides its own fixture for installation on a recreational vehicle.

A particular advantage of the latch assembly of this invention is the fact that if the screen door is latched, merely closing the outer closure door against the screen door will automatically disengage the screen door from its frame strike and will capture the screen door to the prime door. This provides for the positive screen latching in the active and passive modes, while preventing inadvertent lock-out, that is, the closing of the prime closure door over a previously locked screen door.

It is accordingly an important object of this invention to provide a latch assembly for a recreational vehicle door system in which a screen door is carried within a prime closure door, for selectively attaching and disengaging the screen door from the prime door.

A further object of the invention is the provision of a latch assembly for a recreational door which provides for the positive retention and simultaneous alignment of a screen door with respect to the prime door.

A still further object of the invention is the provision of a latch assembly, as outlined above, in which the screen door is automatically disengaged from its frame strike and captured within the prime door when the prime door is closed against the screen door, and which may be readily disengaged by retraction of the latch bolt on the screen door.

These and other objects and advantages of the invention will be apparent from the following description, the accompanying drawings and the appended claims.

BRIEF DESCRIPTION OF THE ACCOMPANYING DRAWINGS

DESCRIPTION OF PREFERRED EMBODIMENT

Figure 1:
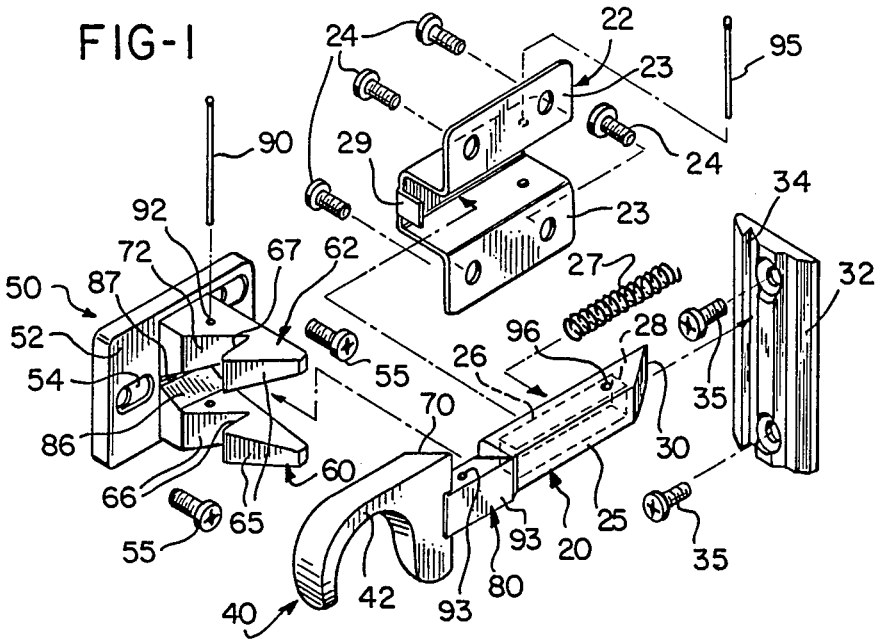
FIG. 1 is an exploded perspective view of a latch assembly according to this invention.

Referring to the figures of the drawings, which illustrate a preferred embodiment of the invention, a latch bolt assembly for a recreational vehicle closure door arrangement is shown generally in FIG. 1. It is understood that the closure door arrangement which uses the latch assembly of this invention is one in which a screen door is hinged about a common hinge or pivot axis with a prime or outer closure door, and may move independently of the outer door in that it may be stored within the outer door for concurrent movement, or may be independently latched to the vehicle frame.

Figure 2:
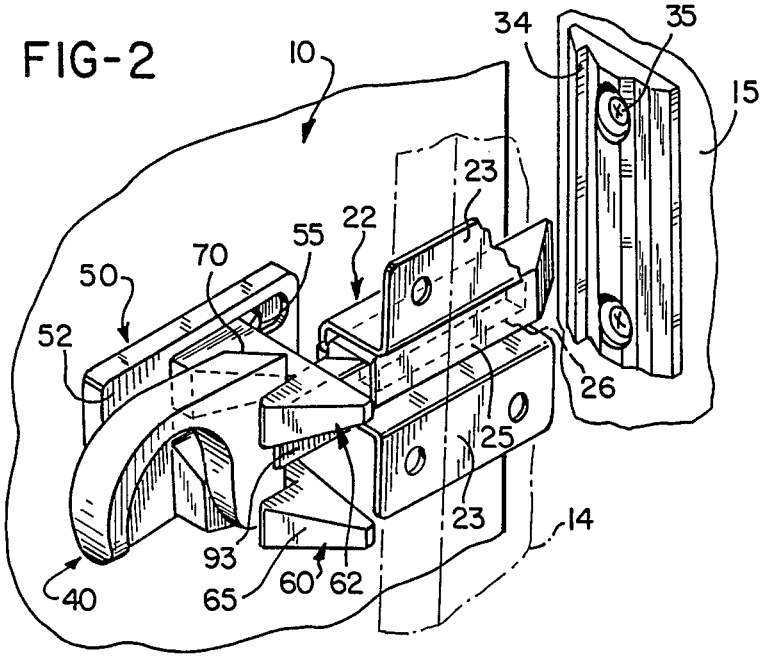
FIG. 2 is an assembled perspective view of the latch assembly with the parts somewhat enlarged from that of FIG. 1.

As shown in FIG. 2, reference numeral 10 represents a fragmentary portion of a prime closure door, and the vertical stile of the screen door 14 is shown in phantom. These are shown, in FIG. 2, in a relatively closed position adjacent a vertical door frame 15 of the vehicle. The parts of the latch assembly making up this invention are shown in exploded perspective view in FIG. 1. A principal part includes a latch bolt 20. The latch bolt 20 is retained in a generally U-shaped latch bolt holder 22 and is adapted for transverse movement with respect to the holder 22 between an extended latching position and retracted positions.

The latch bolt holder 22 is provided with flanged legs 23 by means of which the holder 22 may be mounted against the outside surface of the vertical stile of the screen door 14 with screws 24. A central section 25 of rectangular cross section is reciprocally received within the body of the holder 22. The portion 25 is partially hollow, forming an outwardly facing spring cavity 26 for receiving a compression spring 27. One end of the spring 27 bears on an internal flat wall 28 and the rear end of the spring bears on a tab 29 forming part of the holder 22, thereby urging the latch bolt 20 toward the right in FIGS. 1 and 2.

The forward beveled nose 30 of the latch bolt 20 is proportioned to engage a fixed keeper 32. The keeper 32, as shown in FIG. 2, may be mounted on an inside surface of the door frame 15, and is formed with a generally vertically extending lip 34 against which the end 30 of the latch bolt 20 may rest in the latched position. The keeper 32 may be retained in place by a pair of screws 35.

The latch bolt 20 is formed with an operator portion 40 at the end remote from the beveled nose 30. The portion 40 is formed with a downwardly opening finger engageable loop 42 by means of which the latch bolt 20 may be retracted against the spring 27 for disengagement with the keeper 32. Typically, the loop 42 is accessible through a typical slide opening in the screen door, from inside the recreational vehicle and, of course, is accessible from outside the vehicle when the prime door 10 is open.

The invention further includes a latch bolt retainer 50. The retainer 50 is formed with a base pad 52 by means of which the retainer may be secured to an adjacent inside flat surface of the prime closure door 10, as shown in FIG. 2. Slotted openings 54 in the base pad 52 provide for alignment over conventional retainer screws 55.

The retainer 50 cooperates with the latch bolt 20 to form a secondary latching arrangement, and for this purpose is formed with a pair of generally inwardly-extending latch bolt engaging portions 60 and 62. The portions 60 and 62 are fingers which are integrally formed with the base pad 52 and are slightly spread apart to receive an operative portion of the latch bolt 20 therebetween when the prime closure door 10 is moved against the screen door. The interlatching of the retainer 50 with the bolt 20 aided by tapered cam faces 65 on the fingers terminating in undercut detent notches 66 defining inside retainer faces 67. The faces are formed generally in a plane parallel to the mounting surface of the closure door and form detent means for capturing and retaining the bolt 20 in a retracted position.

The latch bolt operator portion 40 is formed with a tapered planar cam surface 70 which is in proportion to be engaged by the surfaces 65, which surface is formed at approximately the same angle as that of the surfaces 65 so that movement of the retainer 50 into the position as shown in FIG. 2 causes the automatic retraction of the bolt 20 by mutual sliding movement of the bolt 20 and the retainer 50 along the respective surfaces 65 and 70. This continues until the surface 70 has moved past the surfaces 65 and into the detent notches 66, as urged by the spring 22. The inside faces 67 engage the outer surface of the portion 40 and the cam surface 70 is urged into engagement with tapered inside surfaces 72 on the retainer so that the bolt 20 is accurately located in spaced relation to the outer door 10.

Figure 5:
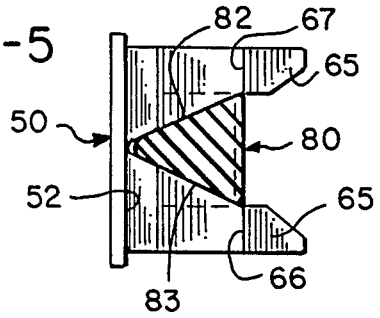
FIG. 5 is a sectional view of the latch bolt taken generally along the line 5—5 and shown in a nested position with respect to the latch bolt retainer.
Figure 6:
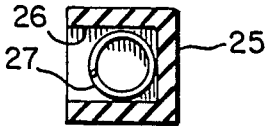
FIG. 6 is a further transverse section through the latch bolt taken generally along the line 6—6 of FIG. 4.

Concurrently with this capturing movement, a centering force is applied to the bolt, and hence through the holder 22 to the screen door. This is accomplished by the interengagement of an intermediate latch bolt portion 80, positioned between the rectangular portion 25 and the finger loop 42, and proportioned to be received between the fingers 60 and 62. The portion 80 forms a pair of converging tapered faces 82 and 83, as best shown in FIG. 5. These surfaces, in the captured mode, are caused to be nested within the retainer 50, and within a pair of mating and cooperating tapered surfaces 86 and 87 which define a converging space between the latch bolt engaging portions 60 and 62 and the mounting pad 32. The internested and interconnected condition of these parts is shown in the sectional view in FIG. 5, and is illustrated further in FIGS. 2 and 7. The mutually tapered faces 82 and 84 defined on the intermediate portion 80, and the cooperating surfaces 86 and 87 formed on the retainer 50, assure the desired vertical alignment of the screen door with respect to the outer closure door in the primary mode. Thus, closing of the primary door against the screen door automatically operates to retract the bolt 20 from the keeper 32, and to reseat the bolt 20 on the retainer 50, and in this position, the nose 30 clears the keeper lip 34. This condition is shown in full line in FIG. 7.

Figure 3:
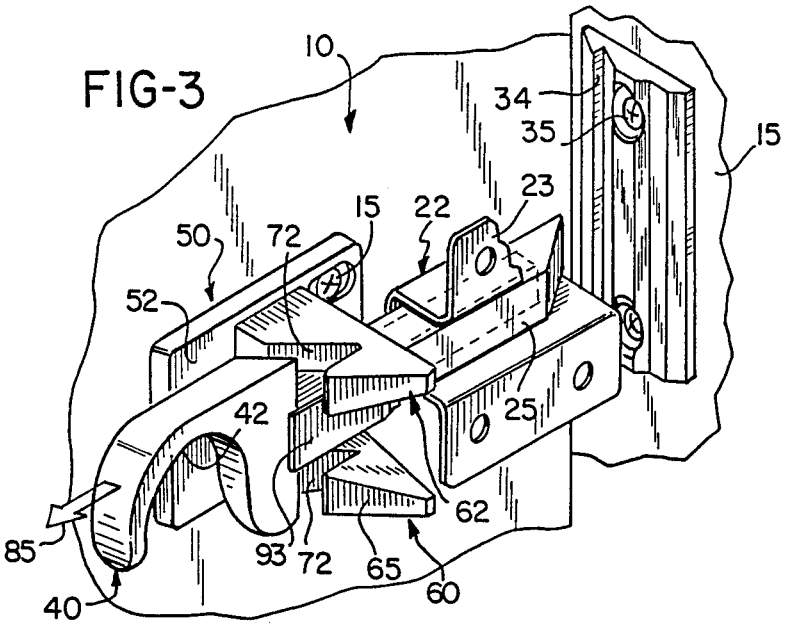
FIG. 3 is a perspective view of the assembly of FIG. 2 showing the parts in a moved position.
Figure 4:
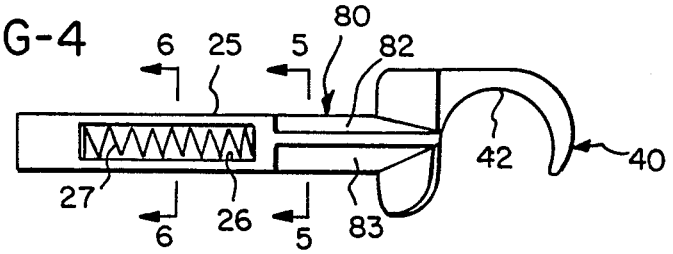
FIG. 4 is a back elevational view of the latch bolt.
Figure 8:
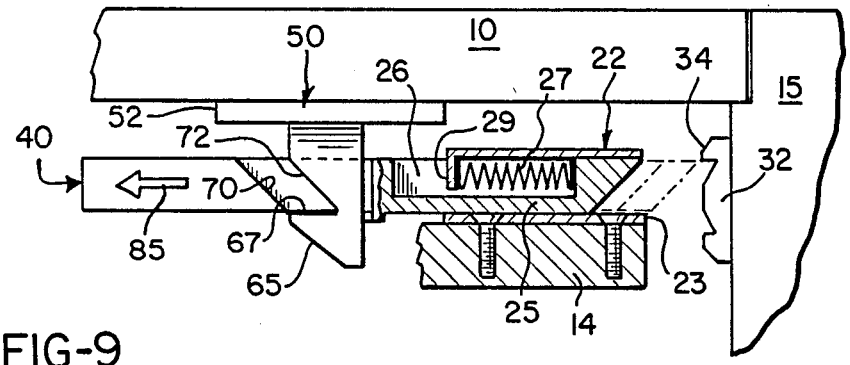
Figure 9:
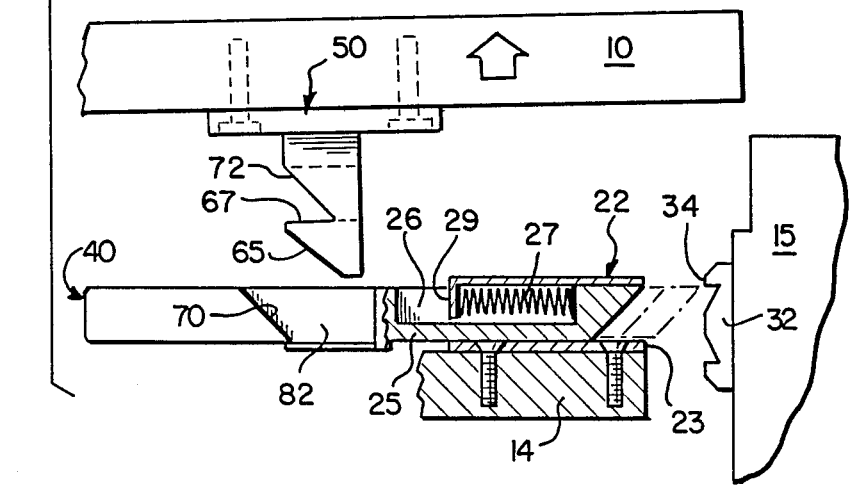

When it is desired to release the screen door from the prime door, it is only necessary to retract the bolt 20 against the spring 27 in the direction indicated by the arrow 85 in FIGS. 3 and 8, thereby release the secondary latch between the retainer 50 and the bolt 20, by causing the bolt portion 40 to clear the retaining ledges 67, as shown in FIGS. 8 and 9, followed by outward movement of the door 10 and, if desired, a relatching of the screen door to the door frame.

Figure 7:
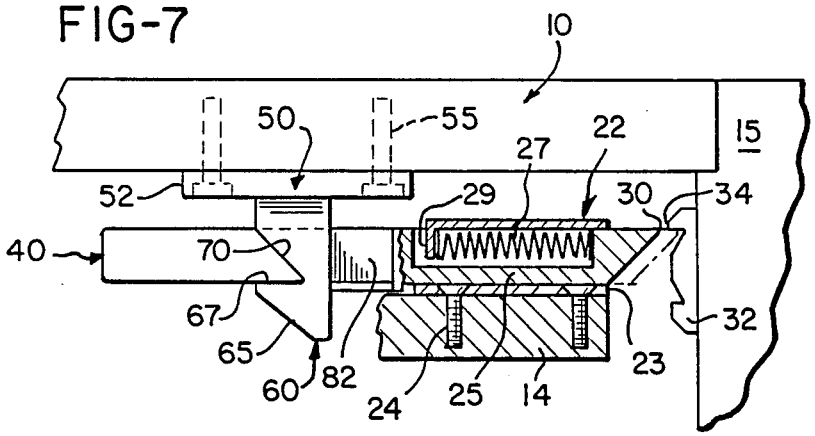
FIGS. 7-9 are progressive views of the latch assembly of this invention, with the latch bolt partially sectioned, and showing the position of the parts during certain conditions of operation.

The operation of the latch assembly of this invention is largely self-evident from the foregoing description. Reference may be had to the sequential views of FIGS. 7–9 in which FIG. 7 illustrates the condition in which the screen door is captured for movement with the prime door and in which the bolt 20 is held in its seated retracted position on the retainer 50. In this position, the nose 30 clears the keeper 32 and the screen door is vertically aligned with respect to the prime door by reason of the interaction of the generally V-shaped or sloping surface or surfaces 82 and 83 on the bolt portion 80, and the mating surfaces 86 and 87 on the retainer 50.

Extraction of the bolt 20 from the retainer 50 is illustrated in FIG. 8 by the further retraction of the bolt against the compression spring, in the direction of the arrow 85, such as by the insertion of a finger in the loop 42 to withdraw the loop out of the confines of the latching fingers 60 and 62, as shown in FIGS. 8 and 9.

As previously noted, the parts of the latch assembly of this invention may be prepositioned and retained by the use of temporary alignment pins, and in this manner, the latch assembly provides its own fixture for installation on a recreational vehicle. With reference to FIG. 1, the withdrawn pin 90 may be inserted through aligned openings 92 in the retainer and through an opening 93 formed in the portion 80, thereby retaining the latch bolt 20 in a predetermined position with respect to the retainer 50. The latch bolt 20 may further be accurately pre-positioned with respect to the latch bolt holder 22 by a second alignment pin 95. The pin 95 extends through openings in the U-shaped portion of the holder 22 and through an alignment hole 96 formed in the rectangular portion 25. After assembly on the respective doors 10 and 14, the pins 90 and 95 may be extracted and discarded, thereby assuring the subsequent proper alignment of the latch assembly.

It will accordingly be understood that the invention provides a latch assembly for a recreational vehicle in which an outer or prime closure door and a screen door, hinged about a common axis, may be operated independently or concurrently, in which the latch assembly provides for the automatic capture and retention of the screen door within the prime door simply by closing the prime door, even if the screen door is already latched. Inadvertent lock-out is thus avoided, and at the same time, the screen door is maintained in a desired alignment with respect to the prime door, and accordingly, with respect to the peripheral door seals.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A latch assembly specifically adapted for use with the closure doors of a recreational vehicle in which a screen door is hinged about an axis in common with an outer vehicle closure door, and in which the screen door may be operated independently of the closure door or stored for movement concurrently with the closure door, comprising:

a latch bolt, means adapted for mounting said latch bolt on a vertical stile of such a screen door, said latch bolt having an outer end engageable with a keeper plate on such a recreational vehicle in an extended position of said bolt, said latch bolt being movable to a retracted position clear of the keeper plate, spring means urging said bolt into said extended position, a latch bolt retainer, means adapted for mounting said retainer on such an outer closure door, said retainer having latch bolt-engaging portions which are proportional to engage said latch bolt when a closure door on which it is mounted is closed against such a screen door and operable to retract said bolt against said spring means to said retracted position, means on said latch bolt retainer capturing said latch bolt within said retainer in said retracted position, and said latch bolt being manually movable for disengagement from said retainer by retraction movement of said bolt against said spring means.

2. The latch assembly of claim 1 in which said retainer comprises a base, a pair of fingers extending from said base and terminating in inwardly turned detent ends, said fingers being proportioned to receive said latch bolt therebetween when such a closure door on which it is mounted is closed over such a screen door, loop means on said latch bolt inner end, said loop means being movable behind said inwardly turned detent ends of said retainer fingers for capturing said latch bolt.

3. For use with a self-storing screen door assembly for a recreational vehicle in which a screen door is selectively attached to an outer door and hinged along a generally common door jamb with the outer door permitting the outer door to open and close in common with the screen door or separate therefrom, the improved latch assembly comprising:

a latch bolt having an outer striker plate-engaging nose end and an inner end, means adapted to mount said latch bolt on such a screen door for transverse movement thereon from an extended striker plate-engaging position, for retaining the screen door in a closed position on a recreational vehicle, to a retracted position freeing the screen door from the striker plate, means on said latch bolt defining a finger-engaging portion on said inner end thereof, a latch bolt retainer member, means adapted to mount said retainer member on such an outer door, said retainer member having generally inwardly-extending latch bolt-engaging portions which are proportioned to engage said latch bolt at said finger-engaging portion, cooperating cam means formed on said inwardly-extending portions urging said latch bolt into said retracted position, and detent portions formed within said cam portions for capturing said latch bolt at said finger-engaging portion.

4. The latch assembly of claim 3 further comprising means on said latch bolt intermediate said nose end and said inner end, and cooperating means on said retainer providing vertical positioning of said latch bolt with respect to said retainer.

5. The latch assembly of claim 3 in which said intermediate latch bolt means comprises a pair of converging, generally planar surfaces, and in which said cooperating means comprises a mating pair of surfaces between said latch bolt-engaging portions.

6. The latch assembly of claim 3 in which said retainer member comprises a door mounting base, and said latch bolt-engaging portions include a pair of transversely-extending fingers, each of said fingers terminated in sloped outer cam surfaces defining said cam means, and said latch bolt finger-engaging portion has a cooperating cam surface engageable with said cam means, and in which said detent portions comprise an undercut ledge on each of said fingers proportioned to receive said finger-engaging portion for capturing said latch bolt on said retainer member.

* * * * *